US012391429B2

(12) United States Patent
López Crespo et al.

(10) Patent No.: US 12,391,429 B2
(45) Date of Patent: Aug. 19, 2025

(54) SHIPPING BOX AND METHOD FOR USING SHIPPING BOX

(71) Applicant: Embalajes Capsa, S.L., Barcelona (ES)

(72) Inventors: Laura Carmen López Crespo, Barcelona (ES); Manuel López Masagué, Barcelona (ES)

(73) Assignee: Embalajes Capsa, S.L., Barcelona (ES)

( * ) Notice: Subject to any disclaimer, the term of this patent is extended or adjusted under 35 U.S.C. 154(b) by 0 days.

(21) Appl. No.: 17/400,014

(22) Filed: Aug. 11, 2021

(65) Prior Publication Data

US 2021/0371152 A1 Dec. 2, 2021

Related U.S. Application Data

(63) Continuation of application No. PCT/ES2020/070112, filed on Feb. 18, 2020.

(30) Foreign Application Priority Data

Feb. 18, 2019 (EP) ..... 19382109

(51) Int. Cl.
*B65D 5/54* (2006.01)
*B65D 5/20* (2006.01)
*B65D 5/66* (2006.01)

(52) U.S. Cl.
CPC ..... *B65D 5/5455* (2013.01); *B65D 5/2052* (2013.01); *B65D 5/6652* (2013.01); *B65D 5/6661* (2013.01)

(58) Field of Classification Search
CPC .... B65D 5/062; B65D 5/0227; B65D 5/2066; B65D 5/5455; B65D 5/6632–6638;
(Continued)

(56) References Cited

U.S. PATENT DOCUMENTS 2,473,492 A * 6/1949 Shina ..... B65D 5/5435 221/305
2,489,528 A * 11/1949 Hirschfeld ..... B65D 5/48038 229/120.36

(Continued)

FOREIGN PATENT DOCUMENTS

CN 108045691 * 5/2018 ..... B65D 5/546
CN 108045691 A * 5/2018

(Continued)

OTHER PUBLICATIONS

International Search Report in corresponding Int'l Application No. PCT/ES2020/070112, mailed Jun. 9, 2020, with English translation.

*Primary Examiner* — Nathan J Newhouse
*Assistant Examiner* — Phillip D Schmidt
(74) *Attorney, Agent, or Firm* — Edell, Shapiro & Finnan, LLC

(57) ABSTRACT

A shipping box comprises a bottom, side walls, a lid comprising a flap, a sealing element arranged on the flap to seal the lid, and a temporary closure structure arranged on the flap to temporarily close the lid. The shipping box provides a double closure system (sealing and temporary closure) applicable to any type of box, since both sealing and temporary closure systems are positioned in a single flap of the lid.

17 Claims, 10 Drawing Sheets

(58) Field of Classification Search
CPC ..... B65D 5/541; B65D 5/546; B65D 5/2057; B65D 5/6661; B65D 5/0015; B65D 5/2033
USPC ..... 229/147, 149–150, 154, 136, 222, 102, 229/125.39, 155, 247
See application file for complete search history.

(56) References Cited

U.S. PATENT DOCUMENTS 3,261,537 A * 7/1966 Kistner ..... B65D 5/665 206/424
3,263,899 A * 8/1966 Collura ..... B65D 5/541 229/222
3,362,610 A * 1/1968 Dyke ..... B65D 5/4804 229/122
3,899,119 A * 8/1975 Roccaforte ..... B65D 5/5021 229/164
4,003,515 A * 1/1977 Steele ..... B65D 5/46104 229/148
4,621,764 A * 11/1986 Ragon ..... B65D 5/48038 493/391
5,123,589 A * 6/1992 Cote ..... B65D 5/545 229/149
5,472,138 A * 12/1995 Ingram ..... B65D 71/14 493/137
5,975,415 A * 11/1999 Zehnal ..... B65D 5/541 206/815
2016/0137335 A1* 5/2016 Mora ..... B65D 5/2076 229/115
2016/0214758 A1* 7/2016 Yamamura ..... B65D 5/4266
2018/0257808 A1* 9/2018 Genender ..... B65D 5/6697
2022/0033135 A1* 2/2022 Kairia ..... B65D 5/563

FOREIGN PATENT DOCUMENTS

DE 102005001632 A1 * 7/2006 ..... B65D 5/2095
DE 102005001633 A1 * 7/2006 ..... B65D 5/22
DE 102005001634 A1 * 7/2006 ..... B65D 5/0254
FR 1419392 A 11/1965
FR 3034757 A1 10/2016
WO 2014/006279 A1 1/2014

* cited by examiner

FIG. 13
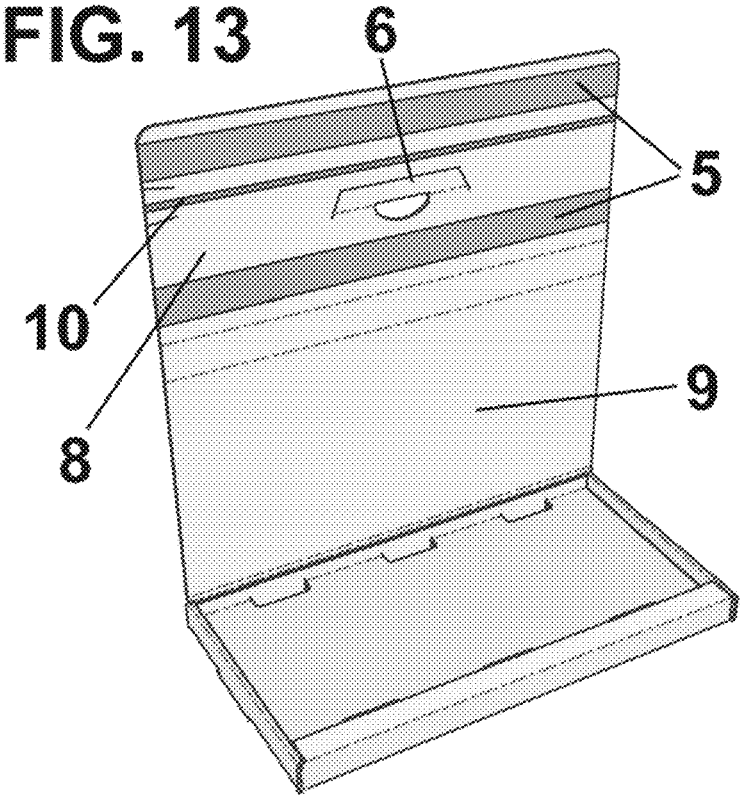
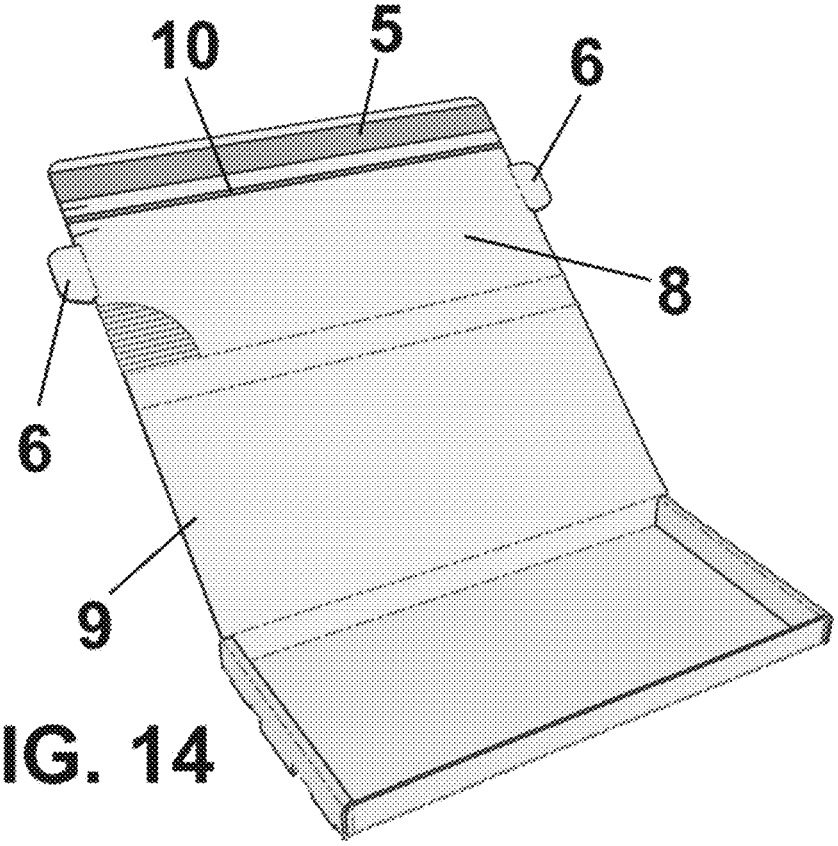
FIG. 14

SHIPPING BOX AND METHOD FOR USING SHIPPING BOX

CROSS REFERENCE TO RELATED APPLICATIONS

This application is a continuation of International Application No. PCT/ES2020/070112, filed on Feb. 18, 2020, which claims priority under 35 U.S.C. § 119 to Application No. EP 19382109.7 filed on Feb. 18, 2019, the entire contents of which are hereby incorporated by reference.

TECHNICAL FIELD

The present disclosure relates to a shipping box, in particular a box for mailing objects. The present disclosure also relates to a method of using a shipping box.

BACKGROUND

Postal boxes are known in the market for sending small objects including an adhesive strip for sealing the box until it reaches its receiver. These boxes are not intended to remain functional after received, nor they can be closed by themselves before using the seal.

For example, there are boxes with a closure fin with an arrowhead in addition to the adhesive tape protected by a protective strip. This design is used to secure closures since once used acting like a hook, it is necessary breaking it to open the box. This is because the width of the closure fin is greater than the length of the slot where it is housed.

Therefore, this type of box is designed to improve the inviolability of the closure and not to allow the temporary closure of the box, the latter being able to be opened and closed as many times as required and in a manner that prevents accidental opening. In addition, often, this fin interferes with the contents of the box, which could hinder its introduction depending on the characteristics and/or dimensions of such content.

Likewise, there are also known boxes with a lid and an adhesive tape protected by a protective strip, as well as a tear strip for subsequently opening the box, characterized in that the lid includes side tabs or flaps which are inserted into the box.

This box cannot be kept closed before shipping, since the side flaps, designed exclusively to improve the inviolability of the box, are not sufficient to close the box safely enough, for example, if the box were to be turned upside-down being filled, before or after shipping.

Moreover, in none of these cases do sellers advertise or mention the possibility of a double closure system for the boxes.

Therefore, it is an object of the disclosed shipping box to provide a double closure option (called sealing and temporary closure) that allows opening and closing the box temporarily safely as many times as required, before and after its tamperproof closure sealing and shipping.

SUMMARY

With the described shipping box, the aforementioned disadvantages are solved, presenting other advantages that will be described below.

The described shipping box comprises a bottom, side walls and a lid, a sealing element for sealing the lid, and a temporary closure structure for the temporary closure of the lid.

Preferably, the sealing element is displaced towards the outside of the box relative to the temporary closure structure.

Advantageously, the sealing element and the temporary closure structure are positioned in the lid. The cap comprises a flap, the sealing element and the temporary closure structure being arranged on the flap.

This arrangement of the sealing element and the temporary closure structure in a single flap of the lid allows to use the sealing element and temporary closure in any type of shipping box.

According to a preferred embodiment, the sealing element comprises an adhesive strip provided with a protective tape, and the temporary closure structure comprises at least one tab housed at least in a complementary slot.

The at least one tab advantageously comprises a folding line, and the width of the at least one tab is equal to or less than the length of the at least one complementary slot, preventing the tab from breaking after a first use, as is the case when the width of the tab is greater than the length of the slot.

In addition, the shipping box according to the present disclosure also comprises a tear strip, which is preferably placed between the sealing element and the temporary closure structure.

According to one embodiment, the tear strip may be placed aligned with the temporary closure structure.

According to a preferred embodiment, the lid also comprises an additional flap, and preferably the additional flap is disposed between the flap and one of the box side walls, or else is arranged hinged to a side wall opposite of the flap.

According to a possible embodiment, the temporary closure structure comprises two side tabs which are housed in each in a complementary slot.

Preferably the at least one slot or the complementary slot(s) is (are) placed on the bottom of the box, but according to one embodiment, the complementary slots are arranged in the box additional flap.

If desired, the sealing element may comprise a second adhesive strip with a protective tape.

Advantageously, the box is formed from a single sheet of corrugated material comprising a plurality of parallel channels, for example, corrugated cardboard. Preferably, the parallel channels of corrugated material are perpendicular to the folding line of the at least one tab.

According to a second aspect, the disclosure also relates to a method for the use of the shipping box as described above, comprising the steps of sealing the shipping box for shipping and temporarily close the shipping box, allowing the step of temporary closure of the shipping box to be made a plurality of times before and after the sealing step of the shipping box.

Therefore, the object of the disclosed shipping box is to provide a double closure option, allowing both to maintain the box temporarily and safely closed, as well as to seal it permanently.

Moreover, since the adhesive tape is protected by a protective sheet, when removing the protective sheet, the sealing of the box is allowed at any time required. Thus, the sender does not need another box-sealing system outside of the box, e.g., a sealing device, strapping or other.

The presence of a tear strip facilitates the opening of the box for a receiver without using a cutting element or breaking the box by force. The option of temporary closure of the box securely as many times as required could be used both before and after using the option of permanent sealing via the adhesive strip protected by the protective sheet, thereby allowing the sender to keep the shipping box temporarily closed, for example, to prepare an order in several steps.

Also, once received the box and unsealed, for example, via the tear strip, the receiver can again keep the box safely closed, i.e., without being accidentally opened by itself, and open it as many times as required.

BRIEF DESCRIPTION OF THE DRAWINGS

For a better understanding of what is disclosed, some drawings are attached, wherein, schematically and only by way of non-limiting example, a practical case of embodiment is shown.

FIG. 13 is a perspective view of a sixth embodiment of the shipping box according to the present disclosure, in its open position;

FIG. 14 is a perspective view of a seventh embodiment of the shipping box according to the present disclosure, in its open position;

DETAILED DESCRIPTION

In FIGS. 1 to 8 it is shown a first embodiment of the shipping box according to the present disclosure.

The shipping box comprises a bottom 1, side walls 2 and a lid 3. According to the illustrated embodiment, the shipping box is formed from a single sheet of corrugated material, preferably corrugated cardboard. The corrugated material comprises a plurality of channels parallel to each other.

The shipping box according to the present disclosure comprises a sealing element and temporary closure structure, which are preferably arranged in the lid 3.

It is noted that the temporary closure structure closes the box safely, i.e., preventing the accidental opening of the box, but also allowing to opening and closing it a plurality of times according to the user's will.

Figure 5:
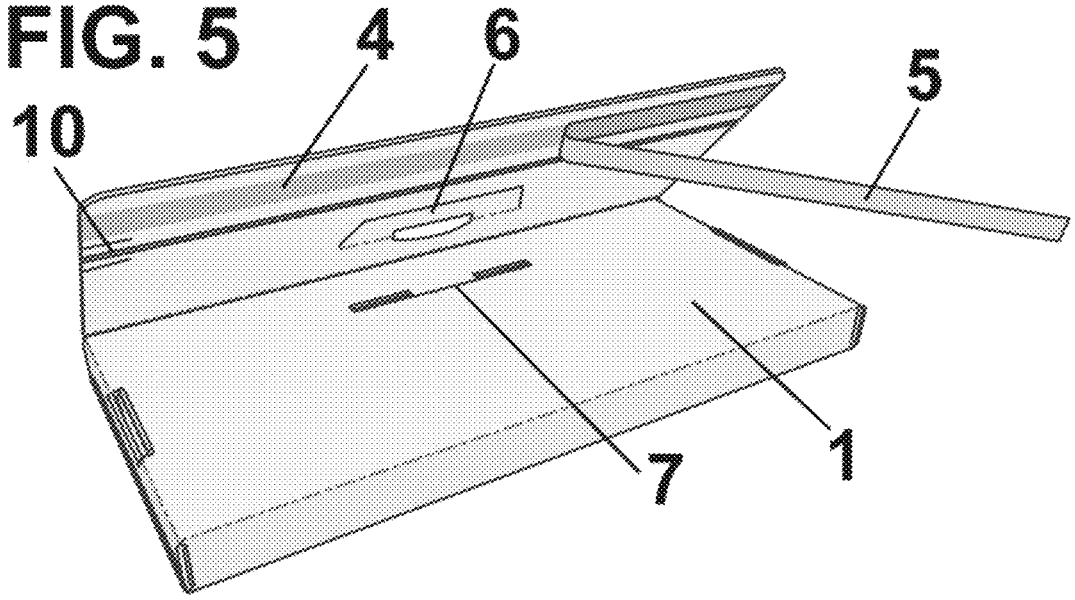
FIG. 5 is a perspective view of the box of FIG. 1 just before sealing.

The sealing element is formed by an adhesive strip 4 which can be seen in FIG. 5, covered by a protective tape 5, removed before sealing the box.

Meanwhile, the temporary closure structure comprises a tab 6 which is housed in a complementary slot 7, which in the embodiment shown is placed on the bottom 1 of the box. It is evident that the temporary closure structure may comprise more than one tab which is housed in a corresponding number of complementary slots.

As shown in these figures, the sealing element 4 is displaced to the outside of the box relative to the temporary closure structure 6.

To facilitate the introduction of the tab 6 into the slot 7, the tab 6 comprises a folding line 13, which allows putting together the tab 6 relative to the flap 8.

Advantageously, the width of the at least one tab 6 is equal to or less than the length of the at least one complementary slot 7, preventing the tab 6 from breaking after a first use.

Also, preferably the corrugated material channels are perpendicular to the folding line 13, reinforcing tab 6 to facilitate its use more than once.

This tab 6 does not interfere with the contents of the box when introduced into the additional slot 7.

The lid 3 of the shipping box according to the present disclosure comprises a flap 8 and an additional flap 9, which are divided by two folding lines allowing the closing of the box.

As shown in the figures, the sealing element (the adhesive strip covered by the protective tape 5) and the temporary closure structure (the flap 6) are arranged in flap 8.

In addition, to facilitate the opening of the box after its sealing, flap 8 also comprises a tear strip 10, which is disposed between the sealing element and the temporary closure structure, i.e., it is disposed between the adhesive strip 4 covered by the protective tape 5 and the tab 6.

Figure 1:
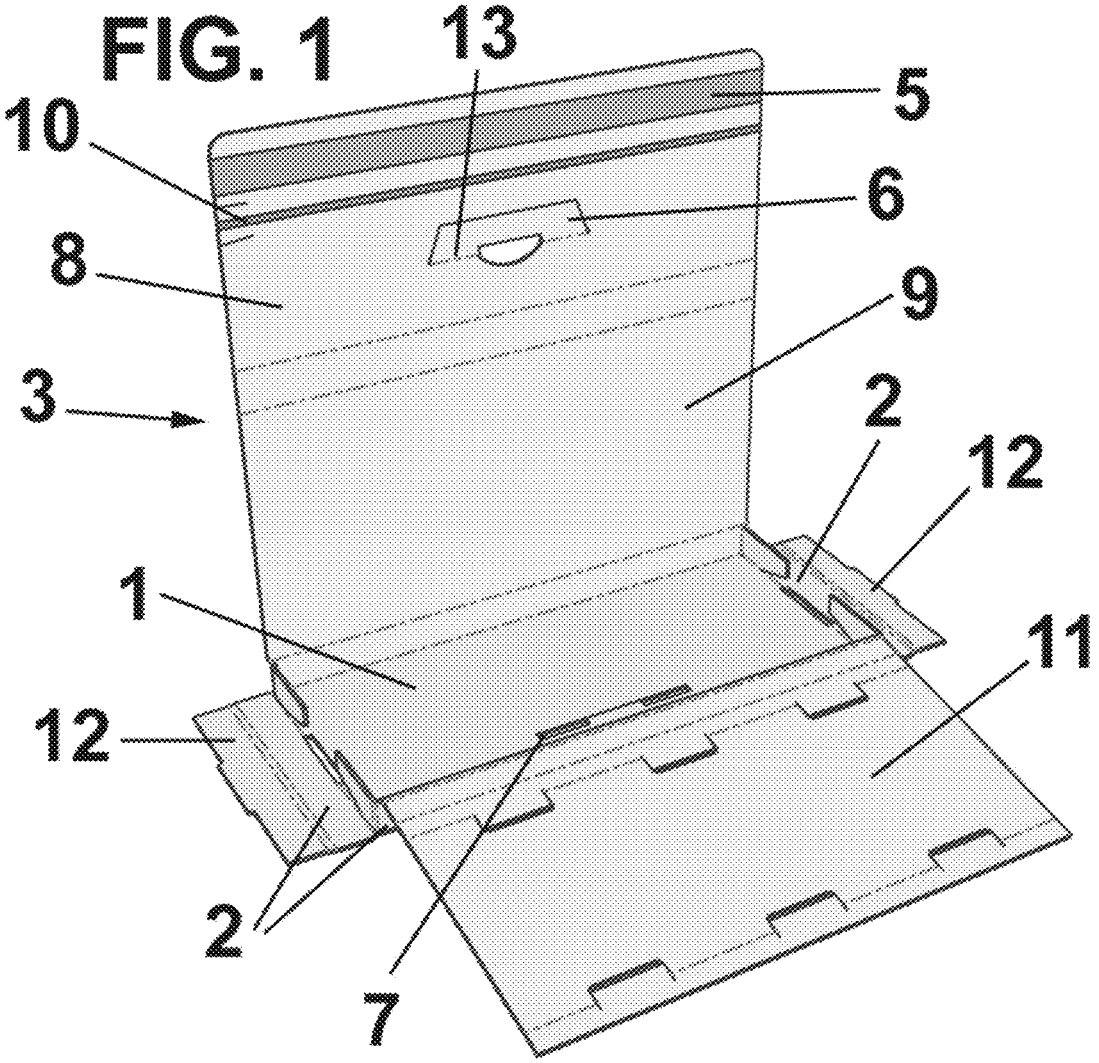
FIG. 1 is a perspective view of a first embodiment of the shipping box of the present disclosure, in a position prior to assembly.

As shown in FIG. 1, the bottom 1 and side walls 2 have a double thickness for reinforcing, the double thickness formed from respective additional flaps (additional flap 11 of the bottom 1, and additional flaps 12 of the side walls 2).

Figure 2:
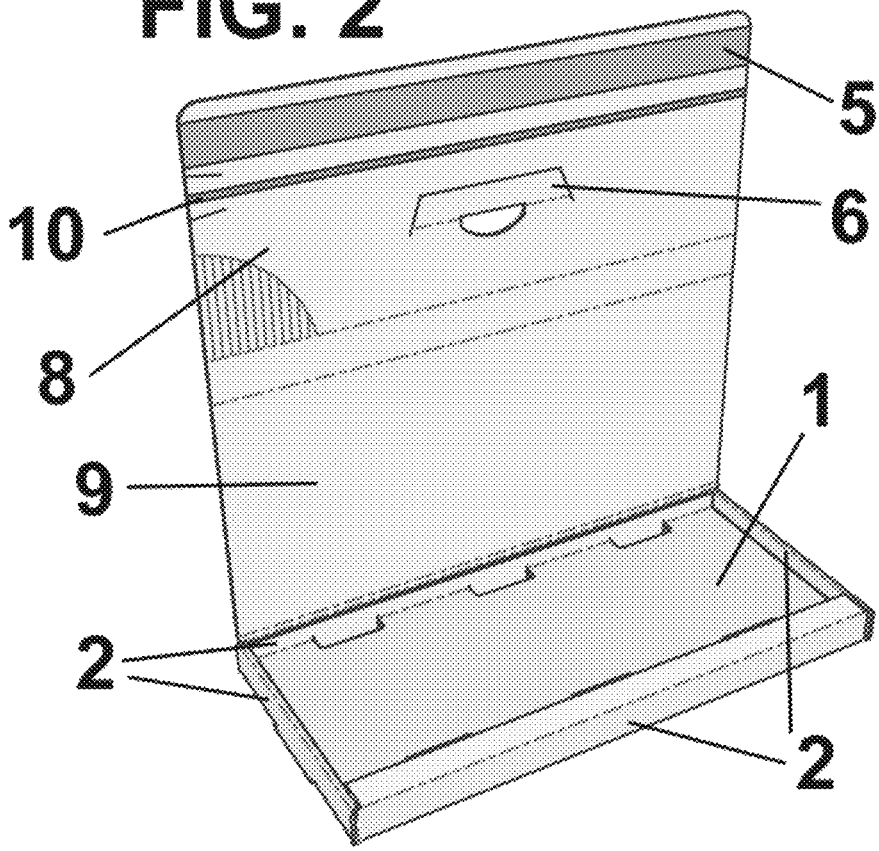
FIG. 2 is a perspective view of the box of FIG. 1 in its open position.

From the single sheet, the additional flaps 11 and 12 are folded on the bottom 1 and the side walls 2, respectively, leaving the box in the open position, shown in FIG. 2.

Figure 3:
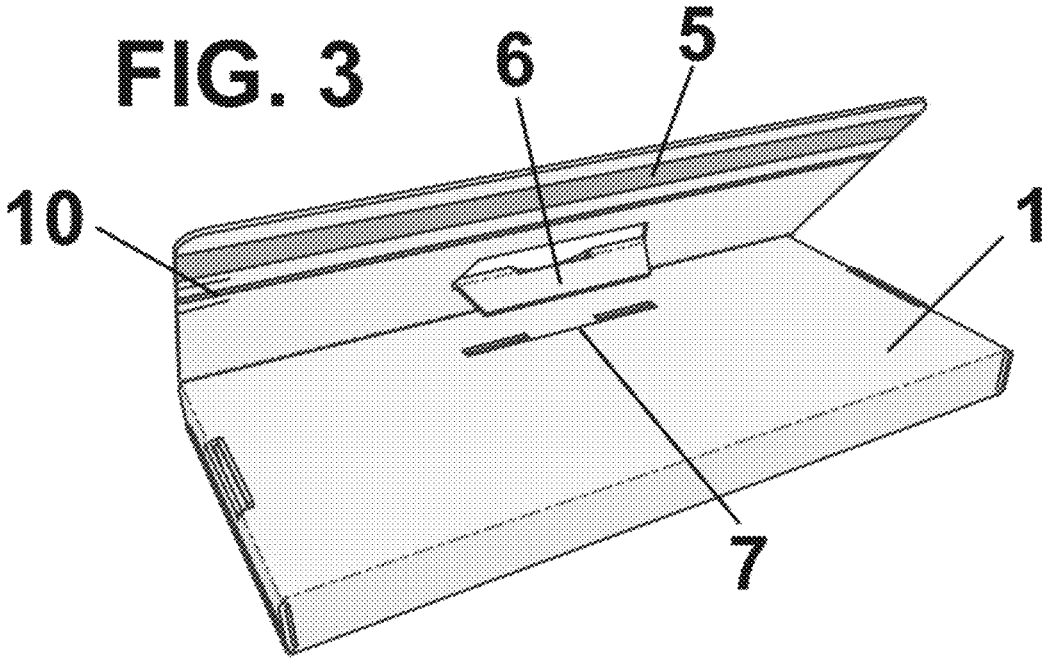
FIG. 3 is a perspective view of the box of FIG. 1 just before its temporary closure.
Figure 4:
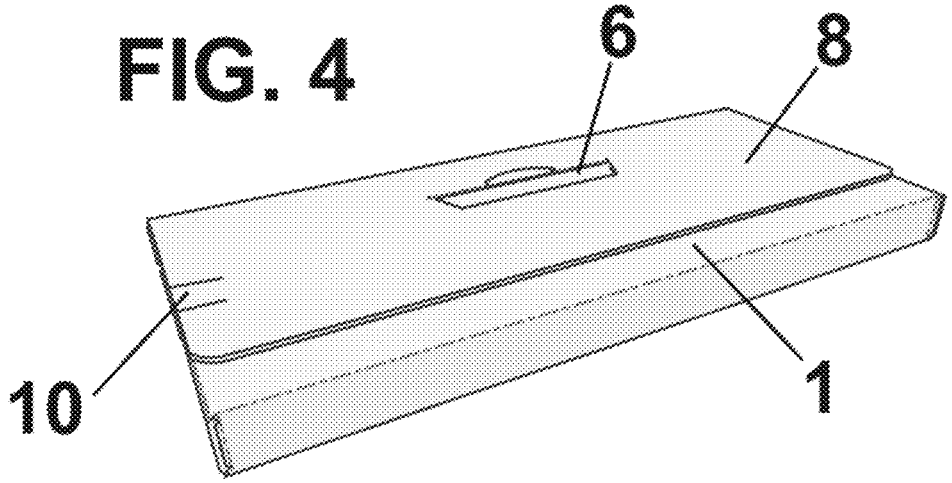
FIG. 4 is a perspective view of the box of FIG. 1 in its position of temporary closure.

To close the box temporarily, the lid 3 is placed on the bottom 1, so that the flap 8 remains on the bottom 1 and the additional flap 9 remains on the side of the box opposite to the bottom 1, so that the tab 6 is introduced into the slot 7, as shown in FIGS. 3 and 4. That is, this temporary closure may be performed before the sealing of the box, and in order to open the box it is just necessary to remove the tab 6 of the slot 7, which can be done as many times as required.

Figure 6:
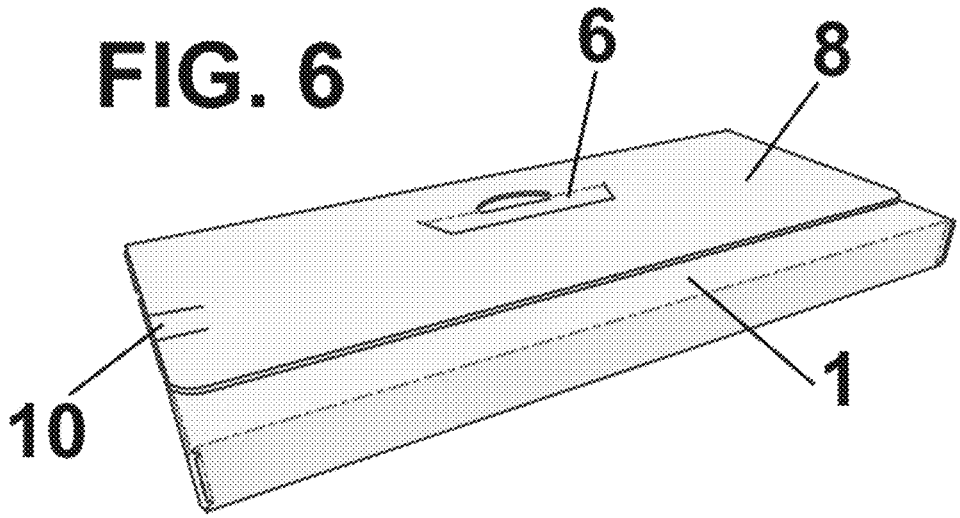
FIG. 6 is a perspective view of the box of FIG. 1 in its sealed position.
Figure 7:
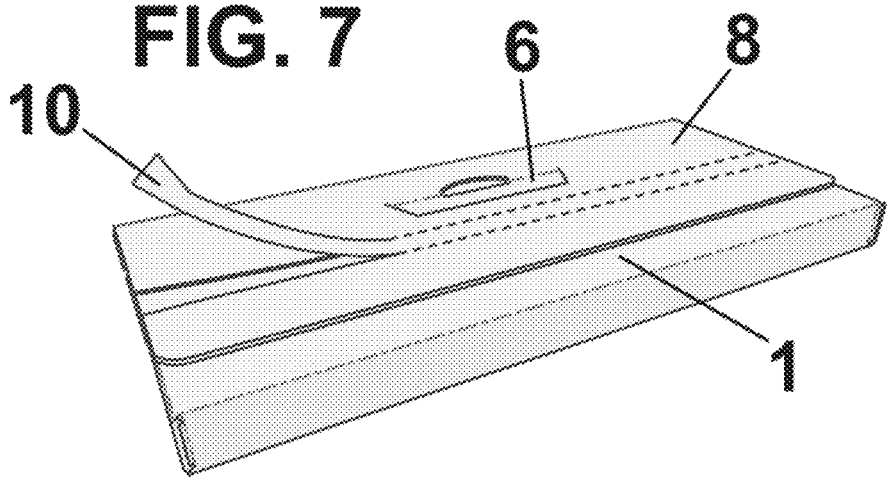
FIG. 7 is a perspective view of the box of FIG. 1 during its opening from its sealed position.

To seal the box the protective tape 5 must be removed (FIG. 5), leaving bare the adhesive strip 4, which allows to fix the flap 8 to the bottom 1 of the box (FIG. 6).

To open the sealed box the tear strip 10 is pulled (FIG. 7) until it falls off entirely from the rest of the box. Thanks to the position of the tear strip 10, a portion of the flap 8 will remain fixed to the bottom 1 of the box, but the other side of the flap 8 will allow to open the box and reach its content.

Figure 8:
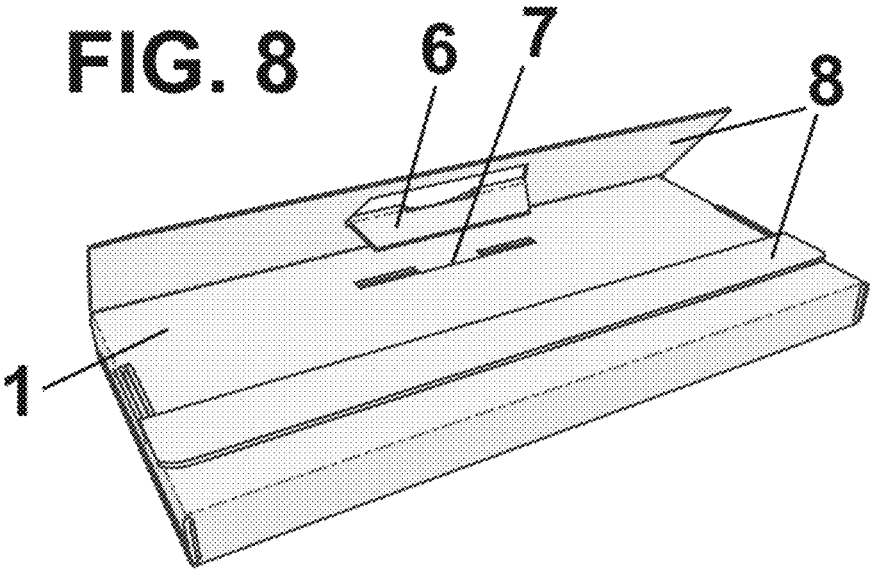
FIG. 8 is a perspective view of the box of FIG. 1 in its temporary closed position after a first seal and shipping.

Since the tab 6 is positioned in this portion of the flap 8, the box may be temporarily closed as often as required after the sealing of the box (FIG. 8).

In FIGS. 9 to 13 there are shown respective embodiments very similar to the first embodiment described.

For simplicity's sake only the differences will be described relative to the first embodiment and the same reference numerals are used to identify the same elements or equivalent elements.

Figure 9:
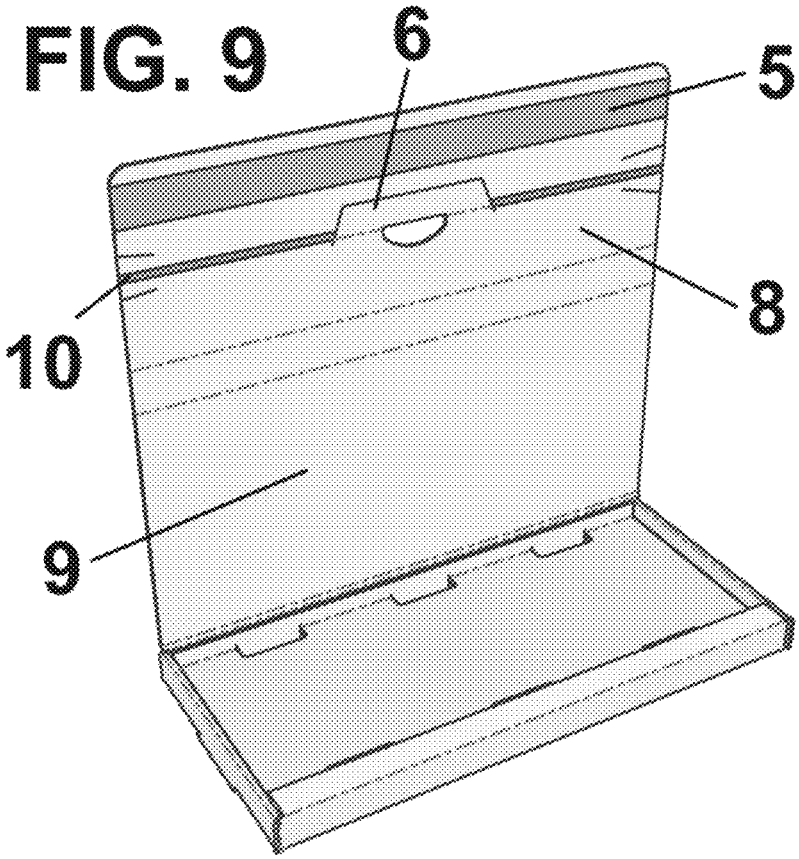
FIG. 9 is a perspective view of a second embodiment of the shipping box according to the present disclosure, in its open position.

In the second embodiment shown in FIG. 9, the main difference is that the tear strip 10 is not positioned between the sealing element and the temporary closure structure, but it is placed aligned with the temporary closure structure, i.e. with the tab 6, in particular with the folding line 13 of the tab 6.

The use of this embodiment box is exactly like the use of the box according to the above embodiment.

Figure 10:
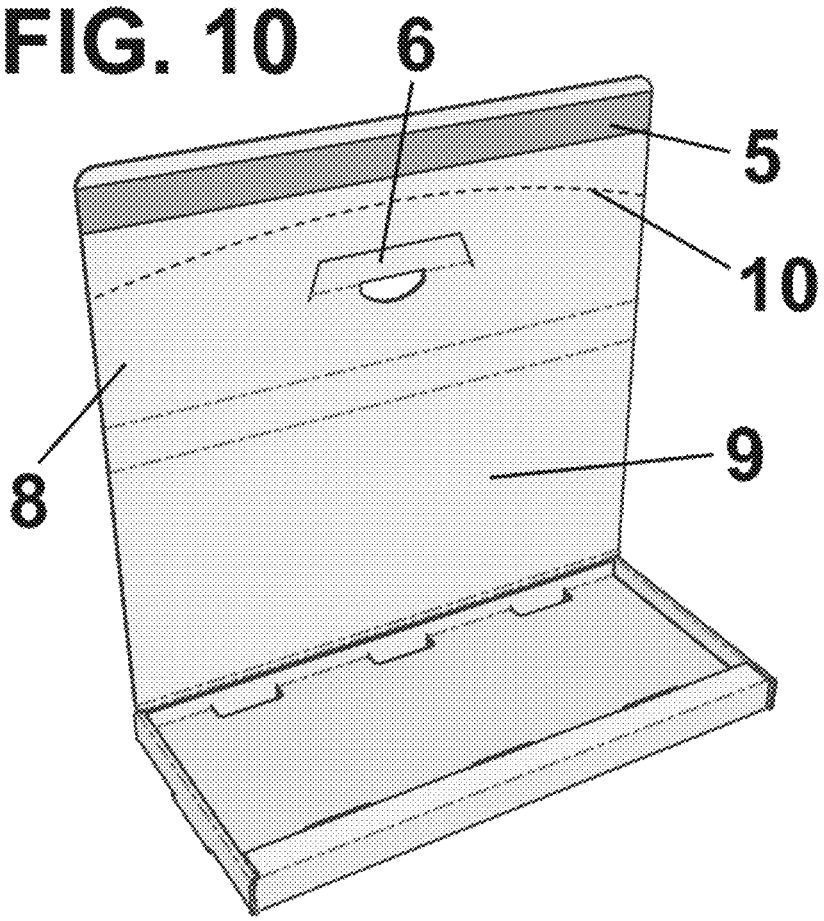
FIG. 10 is a perspective view of a third embodiment of the shipping box according to the present disclosure, in its open position.

In the third embodiment shown in FIG. 10, the main difference is that the tear strip 10 is a tear strip formed by a curved die-cut line located between the sealing element and the temporary closure structure.

It is noted that it should be understood that the term "tear strip" includes any type of strip or line that allows the separation of a portion of the box, in particular a portion of the flap of the box, either a physical strip of any appropriate material or a die-cut line.

Figure 11:
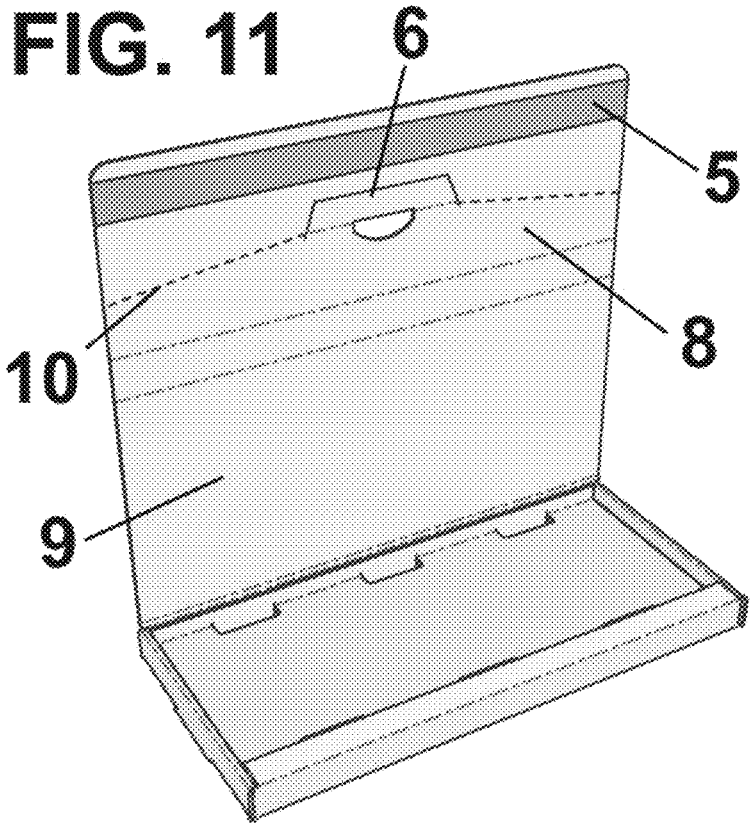
FIG. 11 is a perspective view of a fourth embodiment of the shipping box according to the present disclosure, in its open position.

In the fourth embodiment shown in FIG. 11, the main difference is that the tear strip 10 is a curved die-cut line, whose central portion is aligned with the folding line 13 of the tab.

Figure 12:
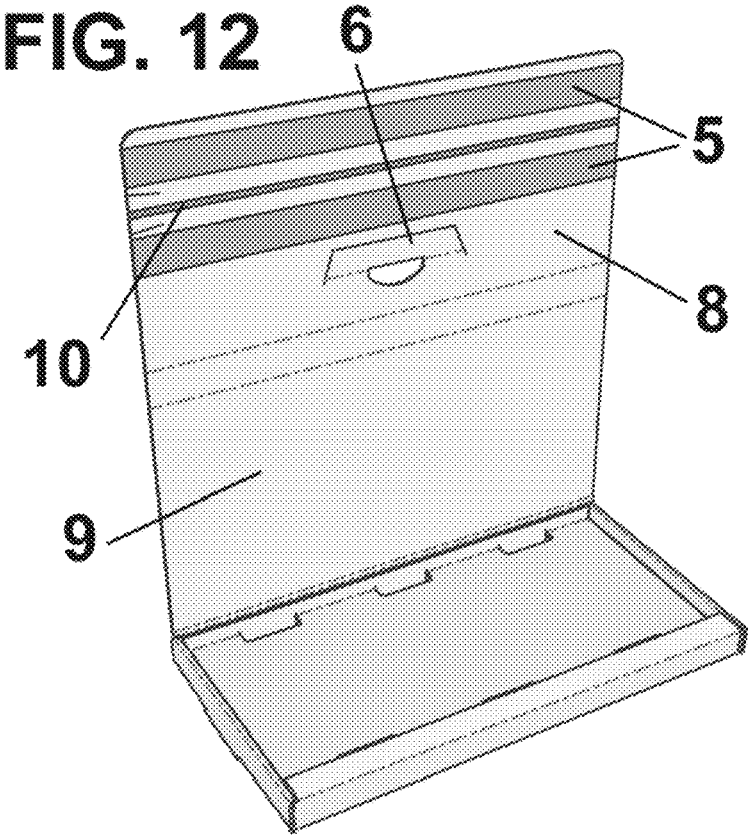
FIG. 12 is a perspective view of a fifth embodiment of the shipping box according to the present disclosure, in its open position.

In the fifth embodiment shown in FIG. 12, the main difference from the first embodiment is the presence of second sealing element allowing to seal the box a second time. For example, the second sealing element is useful for returning a product shipped, without being necessary the use of an external sealing element.

In this embodiment, the second sealing element is arranged between the tear strip 10 and the tab 6.

However, as shown in the sixth embodiment of FIG. 13, the second sealing element may be arranged between the tab 6 and the folding line separating the flap 8 from the additional flap 9.

In these fifth and sixth embodiments, the second sealing element is also preferably formed by an adhesive strip 4 covered by a protective tape 5.

The use of these embodiments box is exactly like the use of the box according to the above embodiments, with the difference that the box can be sealed a second time, for example, for returning the product shipped.

In FIGS. 14 to 17 two additional embodiments are shown, the seventh and eighth embodiments, which have in common, and being a difference from previous embodiments, that the temporary closure structure comprises two side tabs 6 instead of a central tab, as in the above embodiments.

The side tabs 6 are arranged on the sides of the flap 8 of the lid 3.

Figure 15:
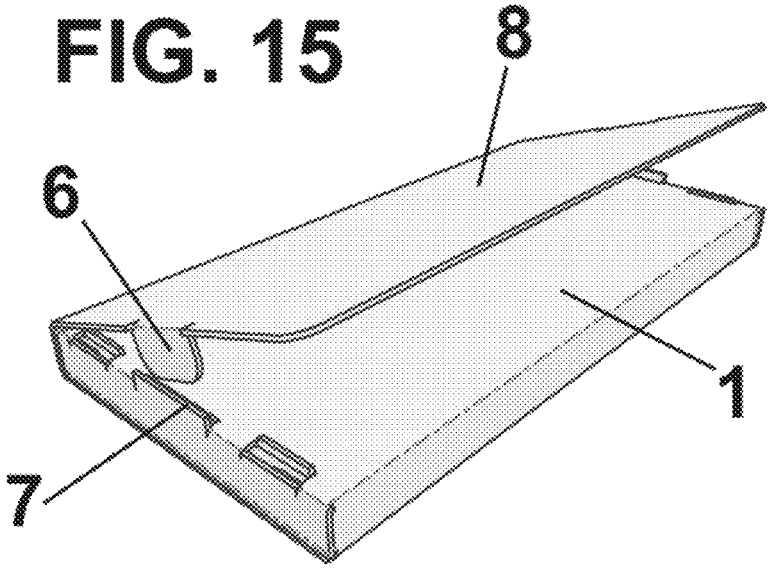
FIG. 15 is a perspective view of the shipping box of FIG. 14 just before its temporary closure.

In the seventh embodiment, the side flaps 6 are housed in complementary slots 7 which are arranged on the bottom 1 of the box, as shown in FIG. 15.

Figure 16:
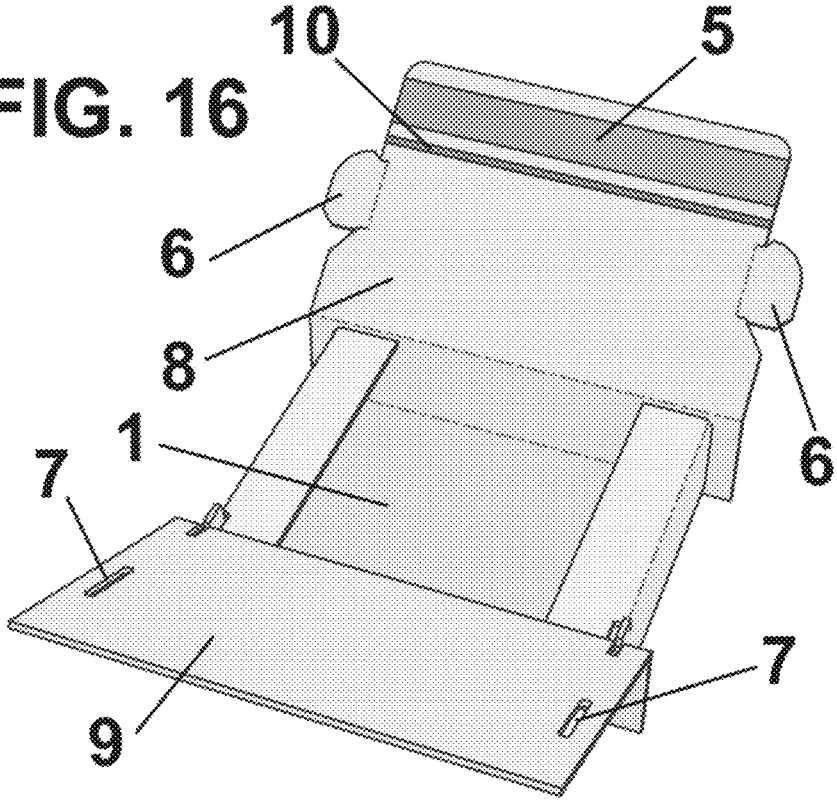
FIG. 16 is a perspective view of an eighth embodiment of the shipping box according to the present disclosure, in its open position.
Figure 17:
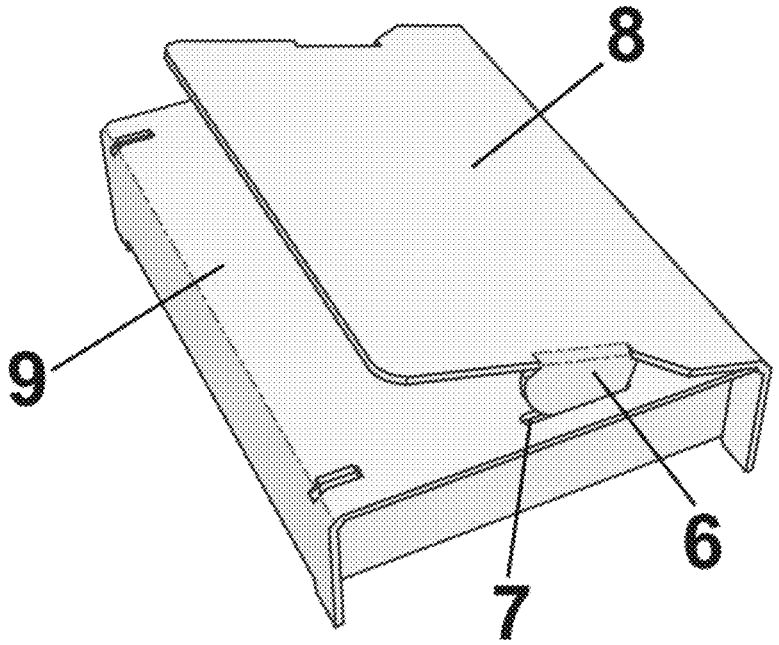
FIG. 17 is a perspective view of the shipping box in FIG. 16 just before its temporary closure.

In the eighth embodiment, the additional flap 9 forming the lid 3 is not attached to the flap 8, but it is hinged to the opposite side wall, as shown in FIG. 16.

Furthermore, in this embodiment, the complementary slots 7 are not arranged on the bottom 1 of the box, but they are arranged in the additional flap 9 of the lid 3.

The use of these embodiments box is exactly like the use of the box according to the first embodiment.

Although it has been made reference to specific embodiments of the disclosed shipping box, it is apparent to one skilled in the art that the shipping box described is susceptible of numerous variations and modifications, and that all the details mentioned can be replaced by other technically equivalent without departing from the scope of protection defined by the appended claims.

What is claimed is:

1. A shipping box, comprising:

a bottom;

side walls;

a lid having a greater surface area than each of the side walls;

a flap extending from the lid and having an outer perimeter bounded by a plurality of sides, including a connection side connecting the flap to the lid, a free side opposing the connection side, and lateral sides extending between the connection side and the free side;

a sealing element arranged on the flap to seal the lid, the sealing element comprising an adhesive strip provided with a removable protective tape; and a temporary closure structure arranged on the flap inboard of the plurality of sides of the flap, the temporary closure structure comprising a tab with a folding line to temporarily close the lid, the flap having an opening extending across a portion of the folding line, the tab being hinged along the folding line to enable insertion into a complementary slot on a surface of the shipping box in a temporarily closed configuration, wherein the complementary slot has a narrow portion defined by a projection of the surface of the box into the complementary slot, the opening on the flap being positioned along the narrow portion of the complementary slot in the temporarily closed configuration, wherein the sealing element is located between the free side of the flap and the temporary closure structure such that the shipping box is capable of being temporarily closed a plurality of times before and after sealing the shipping box with the sealing element.

2. The shipping box of claim 1, wherein the sealing element comprises a second adhesive strip with a protective tape.

3. The shipping box of claim 1, wherein the shipping box is formed from a single sheet of corrugated material comprising a plurality of parallel channels and the parallel channels of the corrugated material are perpendicular relative to the folding line of the tab.

4. The shipping box of claim 1, wherein a width of the tab is equal to or less than a length of the complementary slot.

5. The shipping box of claim 1, wherein the complementary slot is located on the bottom of the shipping box.

6. The shipping box of claim 1, further comprising a tear strip.

7. The shipping box of claim 6, wherein the tear strip is positioned between the sealing element and the temporary closure structure.

8. The shipping box of claim 6, wherein the tear strip is aligned with the temporary closure structure.

9. The shipping box of claim 1, wherein the lid further comprises an additional flap.

10. The shipping box of claim 9, wherein the additional flap is arranged between the flap and one of the side walls of the shipping box.

11. The shipping box of claim 1, wherein the shipping box is formed from a single sheet of corrugated material comprising a plurality of parallel channels.

12. A method of using the shipping box of claim 1, comprising:

sealing the shipping box for shipping using the sealing element; and temporarily closing the shipping box using the temporary closure structure before and after sealing the shipping box.

13. The shipping box of claim 1, wherein the complementary slot is located on the surface of the shipping box inboard of an outer perimeter of the shipping box.

14. A shipping box, comprising:

a sheet provided with a plurality of folding lines enabling folding of the sheet into the shipping box, the sheet comprising:

a bottom;

side walls;

a lid on an opposite side of the side walls from the bottom;

a flap having an end attached to the lid and extending over at least a portion of the bottom;

a sealing element arranged on the flap to seal the shipping box; and a temporary closure structure on the flap between the end of the flap attached to the lid and the sealing element to temporarily close the shipping box by engaging the bottom.

15. The shipping box of claim 14, wherein the temporary closure structure comprises a tab along a folding line, the tab being insertable into a complementary slot in the bottom, the shipping box further comprising an opening extending from the tab to a side of the folding line opposite the tab.

16. The shipping box of claim 14, wherein the sealing element comprises an adhesive strip provided with a removable protective tape and is arranged between the temporary closure structure and a free end of the flap.

17. The shipping box of claim 14, wherein:

the temporary closure structure comprises a tab with a folding line to temporarily close the lid, the flap having an opening across a portion of the folding line, the tab being hinged along the folding line to enable insertion into a complementary slot on the bottom in a temporarily closed configuration; and the complementary slot has a narrow portion defined by a projection of the bottom into the complementary slot, the projection into the complementary slot being adjacent to the opening on the flap in the temporarily closed configuration.

* * * * *